US006881469B2

(12) United States Patent
Hightower

(10) Patent No.: US 6,881,469 B2
(45) Date of Patent: Apr. 19, 2005

(54) EDGE AND CORNER PROTECTOR

(75) Inventor: Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 51 days.

(21) Appl. No.: 10/413,760

(22) Filed: Apr. 15, 2003

(65) Prior Publication Data

US 2004/0209040 A1 Oct. 21, 2004

(51) Int. Cl.[7] ..... B32B 3/06

(52) U.S. Cl. ..... 428/99; 206/453; 206/586; 229/199

(58) Field of Search ..... 428/99, 156, 36.9; 206/586, 453; 229/199

(56) References Cited

U.S. PATENT DOCUMENTS

| | | | | |
|---|---|---|---|---|
| 4,883,179 A | * | 11/1989 | Dionne | 206/523 |
| 5,033,669 A | | 7/1991 | Federico | 229/199 |
| 5,037,027 A | | 8/1991 | Nichols | 229/199 |
| 5,431,336 A | * | 7/1995 | Clee | 229/199 |
| 5,471,799 A | | 12/1995 | Smeja et al. | 52/24 |
| 5,664,374 A | | 9/1997 | Lee | 52/24 |
| D418,403 S | | 1/2000 | Cline | D8/499 |
| 6,368,694 B1 | | 4/2002 | Marsh et al. | 428/99 |
| D457,423 S | | 5/2002 | Mullane | D8/499 |
| D482,604 S | | 11/2003 | Smeja et al. | D8/499 |

* cited by examiner

*Primary Examiner*—Alexander S. Thomas
(74) *Attorney, Agent, or Firm*—Myers Bigel Sibley & Sajovec

(57) ABSTRACT

A protective device that may be used to shield the corner and/or edges of an object from damage during shipping, storage, handling or the like comprises a cap member, first and second outer arms and first and second inner arms. The arms are connected (either directly or indirectly) to the cap member and extend downwardly therefrom. The first and second inner arms are located generally opposite the first and second outer arms, respectively. The first and second inner arms may each include a protrusion that projects toward the first and second outer arms, respectively. Additionally, the first and second outer arms may be positioned so as to define an obtuse angle (e.g., 135 degrees) opposite the vertical plane defined by the downwardly extending first inner arm.

25 Claims, 7 Drawing Sheets

EDGE AND CORNER PROTECTOR

FIELD OF THE INVENTION

The present invention relates to protective devices useful for shielding the edges and/or corners of cabinetry, furniture and other objects during shipping, storage and handling.

BACKGROUND OF THE INVENTION

Wood cabinetry (such as cabinetry for home and kitchen installation) and numerous other objects are often manufactured in plants and then shipped to the location in which they are installed. Often the cabinetry or object at issue is shipped to a central storage location or vendor prior to delivery to the customer, or end user, for installation. The cabinetry or other object can be damaged at any point in the distribution process. Such damage may also occur during the shipment of items, such as, for example, furniture that is fully manufactured and then shipped to another location, such as to a purchaser or a retail sales outlet. In either case, if damage occurs, it is typically necessary to replace the object or deliver a substitute part and repair the object on site. Either choice can be expensive and time consuming. Accordingly, the corners of objects—which are typically the portions that are particularly susceptible to damage—are often shielded by some sort of protector. Such corner protectors are removed and discarded when the object is delivered for installation. One known type of corner protector—which may be used only on 90 degree angle corners—is disclosed in U.S. Pat. No. 6,368,694. Otherwise, current corner protectors typically are rudimentary in nature, such as corrugated paper or plastic corner protectors that are fastened in place with staples or the like, or held in place by the outer packaging (corrugated cardboard, shrink-wrap packaging, etc.) of the object that is to be protected.

SUMMARY OF THE INVENTION

The present invention relates to protective devices that may be used to shield the corner and/or edges of cabinetry, furniture and/or other objects from damage during shipping, storage, handling or the like. Pursuant to one embodiment of the present invention, the protective device comprises a cap member, first and second outer arms and first and second inner arms. The arms are connected (either directly or indirectly) to the cap member and extend downwardly therefrom. The first and second inner arms are located generally opposite the first and second outer arms, respectively, and the first and second inner arms each include a protrusion that projects toward the first and second outer arms, respectively.

Pursuant to another embodiment of the present invention, the protective device is a corner protector that comprises a cap member, first inner and outer arms that are generally opposite each other and second inner and outer arms that are generally opposite each other. The arms are connected (either directly or indirectly) to the cap member and extend downwardly therefrom. In this embodiment, the first and second outer arms are positioned so as to define an obtuse angle (e.g., 135 degrees) opposite the vertical plane defined by the downwardly extending first inner arm. This embodiment may be useful for protecting corners having angles greater than 90 degrees.

In the protective devices of the present invention, the protrusions provided on the inner arms may have a hollow center. The protrusions may be formed as curved bands of material that project from a face of the inner arms. Additionally, a rib may be provided adjacent each location where the protrusions connect to the inner arms. The protrusions may be located external to an outer perimeter that is defined by an upper edge of the cap member. The protrusions may also be configured such that when the protective device is used the distal ends of the inner arms will not come into contact with the object that the device protects.

The protective devices of the present invention may also include one or more ribs on one or both of the inner arms adjacent the connections between the inner arms and the remainder of the protective device. Further, the first arms may be connected to the cap member via a rigid post. At least the inner arms of the protective device may be resilient arms, and in their relaxed states, the first and second inner arms may be substantially aligned with one another. It will also be understood that the protective devices of the present invention, in many instances, may be used to protect both edge portions and corner portions of an object.

The present invention is explained in greater detail in the detailed description and drawings set forth below.

DETAILED DESCRIPTION OF PREFERRED EMBODIMENTS

Figure 1:
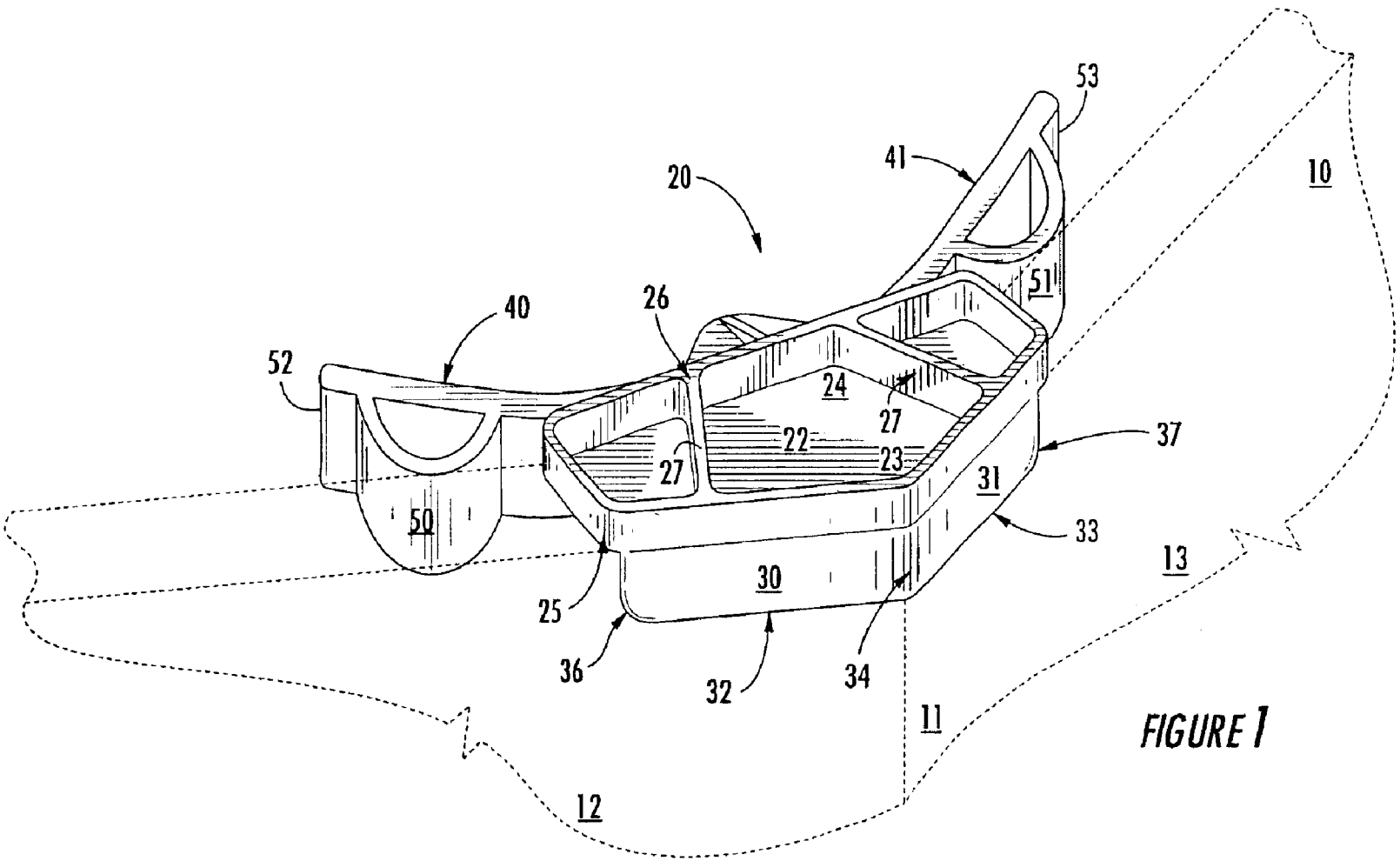
FIG. 1 is a perspective view of a protective device according to the present invention installed on a cabinet having a 135 degree corner.
Figure 2:
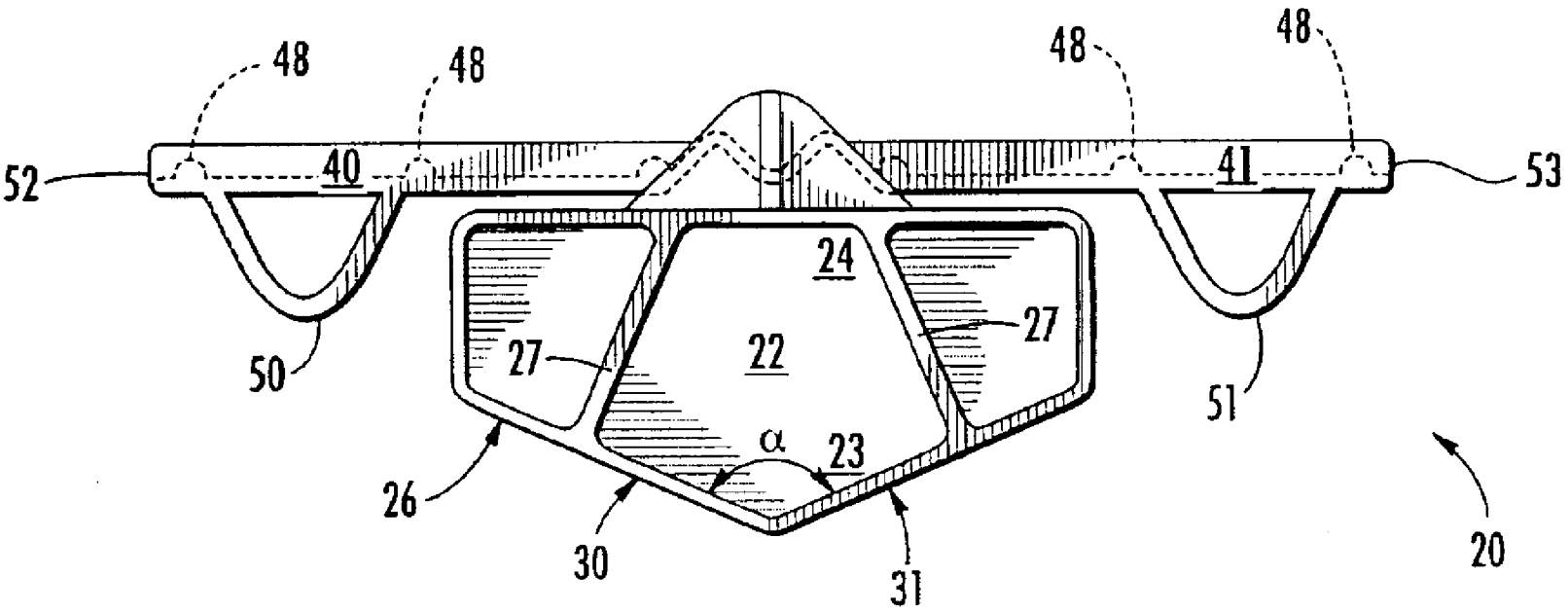
FIG. 2 is a top view of the protective device of FIG. 1 in an uninstalled state.

The present invention will now be described more fully hereinafter with reference to the accompanying drawings, in which preferred embodiments of the invention are shown. This invention may, however, be embodied in many different forms and should not be construed as limited to the illustrated embodiments or other embodiments set forth herein; rather, these embodiments are provided so that this disclosure will be thorough and complete, and will fully convey the scope of the invention to those skilled in the art. In the figures, the dimensions of some components may be exaggerated for clarity.

Referring now to the figures, FIGS. 1–5 depict a protective device 20 that may be used on a cabinet 10 having a 135 degree corner 11. As illustrated, the corner protector 20 comprises a top cap member 22 having an outer portion 23, an inner portion 24, and a generally flat planar bottom portion 25. A first outer arm 30 is connected to, and projects downward from, the cap member 22 outer portion 23. Likewise, a second outer arm 31 is connected to, and projects downward from, the cap member 22 outer portion 23 adjacent the first outer arm 30. Note that as used herein, the term "connected to" is intended to encompass objects that are directly connected to each other and objects that are connected to each other through one or more additional structures. In the pictured embodiment of the present invention, the first outer arm 30 and the second outer arm 31 define an obtuse angle α (see FIGS. 2 and 3) which in the pictured embodiment is approximately 135 degrees. The first outer arm 30 and the second outer arm 31 also each has a generally flat planar bottom edge portion 32, 33 oriented substantially parallel with one another, and substantially parallel with the top member bottom portion 25. The two outer arm members 30, 31 may join to form an apex 34.

Figure 5:
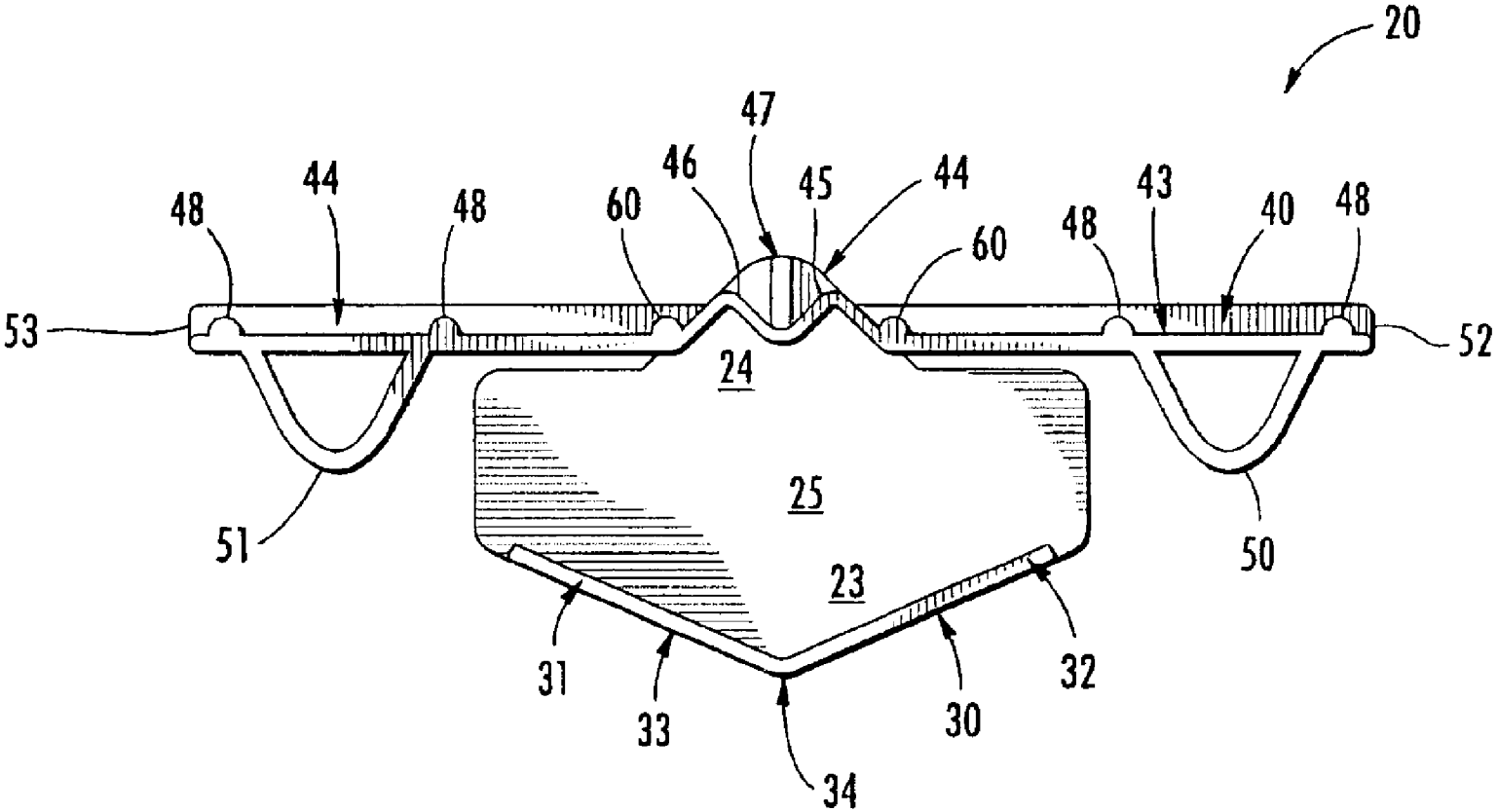
FIG. 5 is a bottom view of the protective device of FIG. 1 in an uninstalled state.

As shown best in FIG. 5, a rigid post 44 may be connected to the bottom portion 25 of the cap member 22 at a position spaced apart from the first outer arm 30 and the second outer arm 31. The rigid post 44 projects downward from the bottom portion 25. Preferably, the rigid post 44 is connected to the bottom portion 25 at a position facing the apex 34 of the first outer arm 30 and the second outer arm 31, and is substantially equally spaced apart from each of the first and second outer arms 30, 31 as shown. A first inner arm 40 may be connected adjacent to and extending outward from one side of the post 44, and a second inner arm 41 may be connected adjacent to and extending outward from the other side of the post 44. The first inner arm 40 may be positioned generally opposite (but not necessarily parallel to) the first outer arm 30, and the second inner arm 41 may likewise be positioned generally opposite (but not necessarily parallel to) the second outer arm 31. The first and second inner arms 40, 41 extend downwardly from the cap member 22 via their connection to the cap member 22 through rigid post 44.

Figure 3:
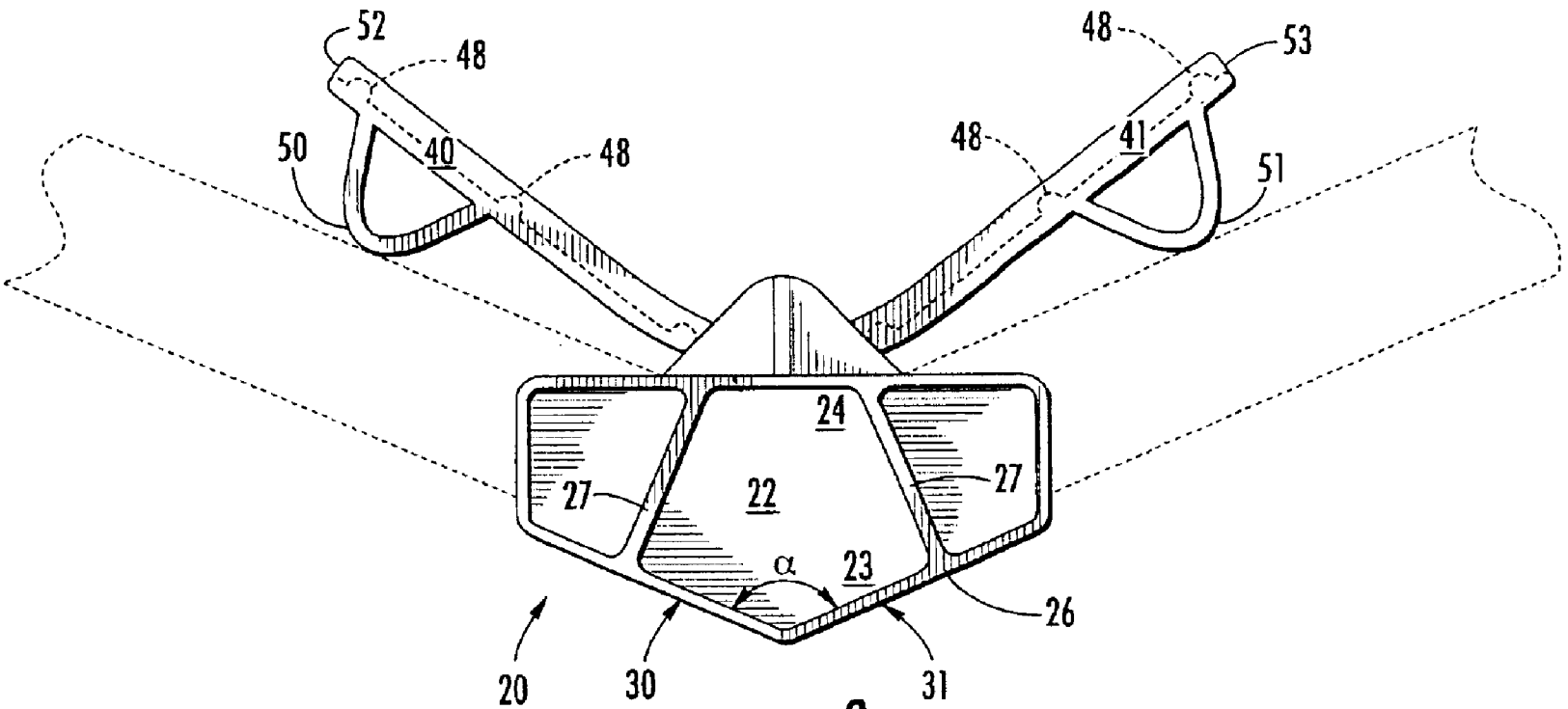
FIG. 3 is a top view of the protective device of FIG. 1 installed on a cabinet having a 135 degree corner.
Figure 4:
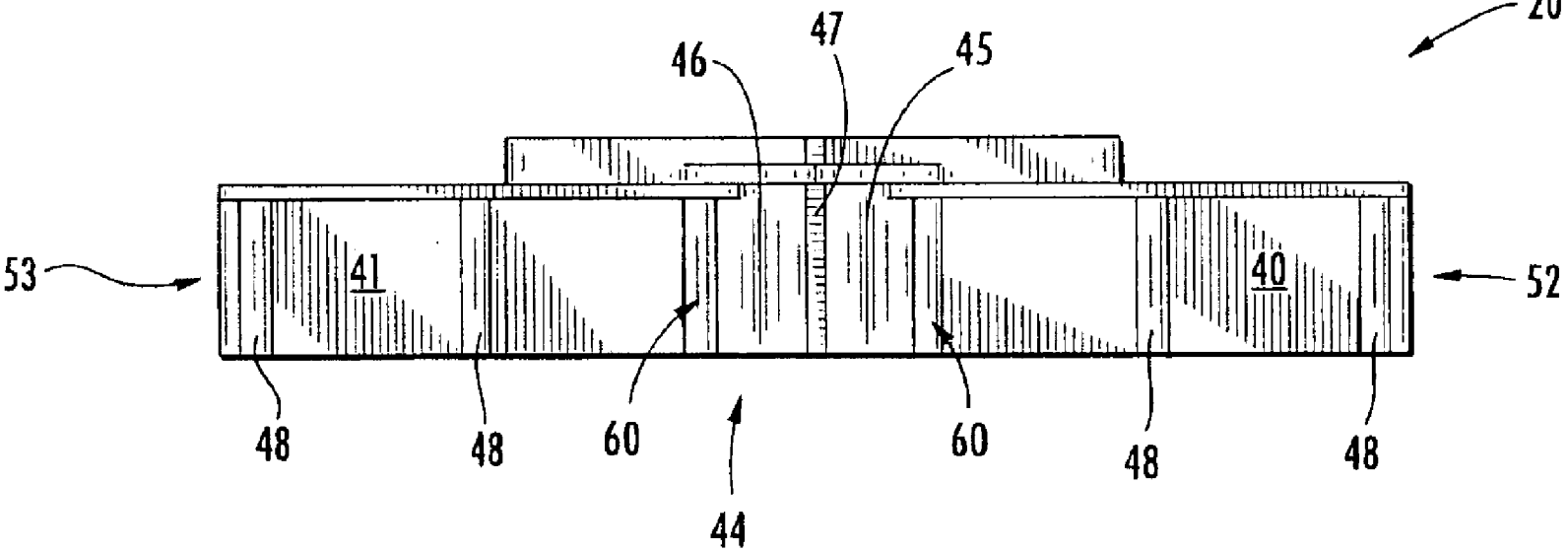
FIG. 4 is a back view of the protective device of FIG. 1 in an uninstalled state.

As shown best in FIG. 3, the first outer arm 30 and the second outer arm 31 may be substantially rigid, while the first inner arm 40 and the second inner arm 41 may be relatively resilient, flexing at their point of attachment to the rigid post 44. The first inner arm 40 and the second inner arm 41 may be substantially coplanar. As illustrated best in FIG. 3, the relatively resilient first and second inner arms 40, 41 rotate about their respective points of attachment to the rigid post 44. In certain embodiments of the invention, the rigid post 44 may be reinforced so as to facilitate having only the first and second inner arms 40, 41 deform when forces are applied to respective the distal ends 52, 53 thereof. For example, as shown in FIGS. 4 and 5, reinforcing ribs 60 may be provided at the locations where the first and second inner arms 40, 41 connect to the rigid post 44. As is shown in FIG. 5, the rigid post 44 may be formed so as to be more rigid than the first and second inner arms 40, 41. For example, the rigid post 44 may comprise a pair of downwardly extending V-shaped walls 45, 46. The first inner arm 40 extends outwardly from V-shaped wall 45 and the second inner arm 41 extends from V-shaped wall 46. The resilient first and second inner arms 40, 41 deflect about their respective junctions with rigid post 44. Those of skill in the art will appreciate that numerous other means of providing a post 44 that has increased rigidity may be employed, such as thickening the section of material used to form the rigid post 44 or providing one or more reinforcing gussets (such as the gusset 47 shown in FIG. 5). Those of skill in the art will appreciate in light of the present disclosure that having the resilient arms (in this case first and second inner arms 40, 41) connect to the protective device 20 at or adjacent a reinforced rigid post 44 can improve the structural integrity of the protective device 20.

The first inner arm 40 may include a protrusion 50 near its distal end 52 and the second inner arm 41 may include a protrusion 51 near its distal end 53. In the illustrated embodiment, the protrusions 50, 51 are generally U-shaped and project from the respective faces of the first and second inner arms 40, 41 that are generally opposite the first and second outer arms 30, 31. As shown best in FIG. 3, when installed the protrusions 50, 51 contact the inner edge of the object 10 to be protected. The inclusion of these protrusions 50, 51 provides several distinct advantages.

First, the protrusions 50, 51 may be designed so that when the protective device 20 is installed, the distal ends 52, 53 of the respective first and second inner arms 40, 41 do not engage the object 10 (see FIG. 3). This arrangement facilitates removal of the protective device 20 since the person removing the device can easily and conveniently grasp the protective device 20 at the distal ends 52, 53 of the first and second inner arms 40, 41 and squeeze the first and second inner arms 40, 41 toward each other, thereby disengaging the arms 40, 41 from the object 10 to be protected. If the protrusions 50, 51 were not provided, the first and second inner arms 40, 41 would directly abut the inner edge of the object 10. Moreover, the first and second inner arms 40, 41 would be held in place by the force that the arms 40, 41 apply in trying to return to their relaxed state (i.e., the position that the arms 40, 41 assume when the protective device 20 is not installed on an object 10), thereby making it more difficult and time-consuming to grasp and squeeze together the first and second inner arms 40, 41 so as to remove the protective device 20 from the object 10.

Second, the protrusions 50, 51 may be designed to have some degree of resilience such that the protrusions 50, 51 deform to some extent when they engage the object 10. This ability to deform may help protect the object from scratching by the protective device 20 itself.

It will be appreciated by those of skill in the art in light of the present disclosure that the protrusions 50, 51 may be formed in a variety of different ways. Thus, for example, the protrusions 50, 51 may have hollow centers as shown in the illustrated embodiments, or may be formed as solid raised areas on the faces of inner arms 40, 41. Likewise, the protrusions 50, 51 each may comprise a single protrusion or a plurality of protrusions, and the protrusions may be of any shape or configuration. Thus, it will be understood that the protrusions are not limited to the exemplary embodiment depicted in FIG. 1–5.

In a preferred embodiment of the present invention, the protrusions 50, 51 are located near the distal ends 52, 53 of inner arms 40, 41, respectively. In these embodiments, the protrusions 50, 51 may be located sufficiently toward the distal ends 52, 53 of inner arms 40, 41 that they reside external to the "footprint" that is defined by the upper outside edge of the cap member 22 (i.e., when looking down on protective device 20, the protrusions 50, 51 fall completely outside the area defined by the cap member 22).

As illustrated best in FIGS. 1 and 3, the protective device 20 may be installed to protect the corner 11 of an object 10 by placing the cap member 22 over the corner 11 (which is formed by the junction of the walls 12, 13) that is to be protected with the inner face of the first outer arm 30 aligned with the outer face of the wall 12, and the inner face of the second outer arm 31 aligned with the outer face of the wall 13. The distal ends 52, 53 of the respective first and second inner arms 40, 41 are then pressed toward each other, (i.e., first inner arm 40 deflects away from first outer arm 30, and second inner arm 41 deflects away from second outer arm 31) and the protective device 20 may be slipped in place over the top of the walls 12, 13. The distal ends 52, 53 of the respective first and second inner arms 40, 41 are then released, so that the first and second inner arms 40, 41 spring back toward their relaxed positions such that the protrusions 50, 51 engage the inner face of the respective walls 12, 13 as illustrated in FIG. 3.

Note that because of the resiliency of the first and second inner arms 40, 41, the protective device 20 can be used to protect corners or edges on objects having walls of different thicknesses. This is highly advantageous because many corners are formed from two sides (or more correctly, front and side portions, or back and side portions) of different thickness, and there is little standardization of thicknesses in the industry. Hence, the provision of a corner protector that can engage a variety of side thicknesses reduces the need to provide a variety of different corner protectors for cabinets or other objects formed of different thickness materials.

The first and second outer arms 30, 31 and the first and second inner arms 40, 41 may have generally flat, planar, bottom edge portions 32, 33, 43, 44, respectively, that are oriented substantially parallel with one another and substantially parallel with the top member bottom portion.

Ribs 48 can be provided on the first and second inner arms 40, 41 to strengthen the same. In a preferred embodiment, these ribs 48 may be provided at or about the locations where the protrusions 50, 51 connect to the first and second inner arms 40, 41. In the illustrated embodiment, the ribs 48 are located on the face of the first and second inner arms 40, 41 opposite the faces of first and second inner arms 40, 41 from which the protrusions 50, 51 project. It will be appreciated, however, that the ribs 48 could likewise be provided on faces of the first and second inner arms 40, 41 from which the protrusions 50, 51 project. A top ridge or lip along the top surface portion of the first and second inner arms 40, 41 or a bottom ridge or lip along the bottom surface portion of the first and second inner arms 40, 41, can be added in a preferred embodiment (not pictured), perpendicular to the arms 40, 41 themselves, to further strengthen the protective device 20. The ribs 48 may provide support for such a ridge or lip.

The protective device 20 may further include a ridge member 26 connected to the cap member 22 and projecting outward (or upward) therefrom, the ridge member 26 configured to further shield the corner 11 when installed thereon. The ridge member 26 may extend continuously around the entire peripheral edge portion of the cap member 22 (as shown in FIG. 1). The provision of such a ridge 26 is particularly helpful when the protective device is used to protect the bottom of an object 10 because it spaces the object 10 from the floor, or where it is used to protect a top portion of an object 10 that may have other items stacked on top thereof. Reinforcing ribs 27 may also be included to reinforce the ridge 26. The reinforcing ribs 27 preferably are the same height as the reinforcing ridge 26.

Figure 6:
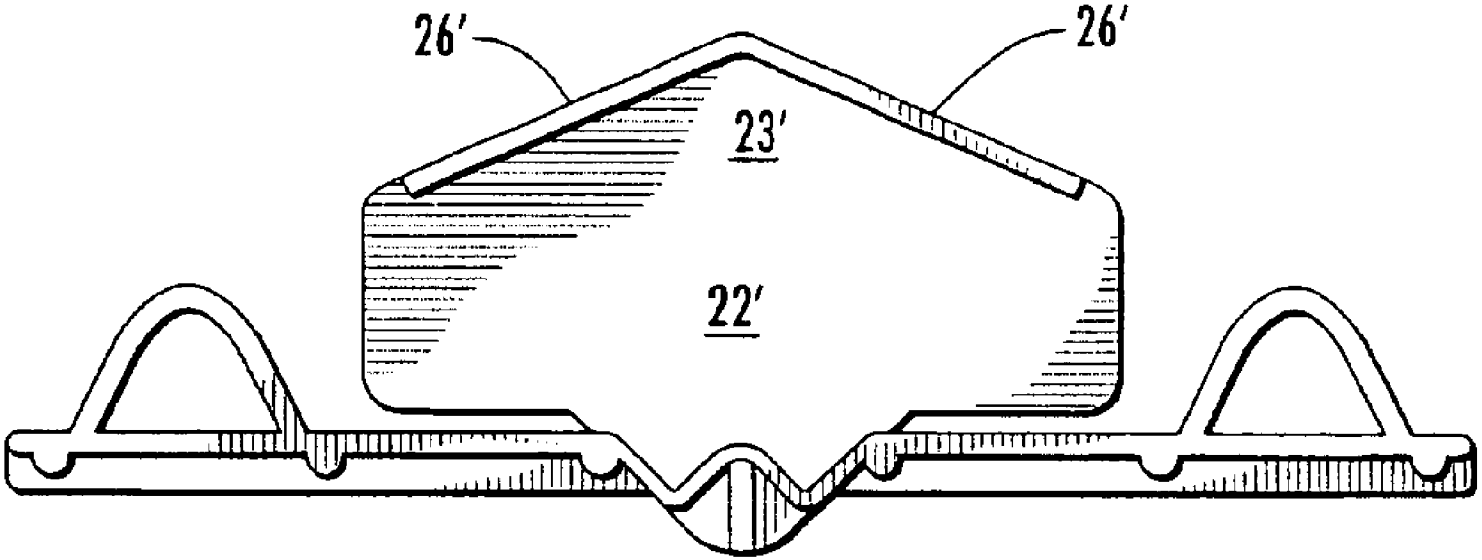
FIG. 6 is a top view of another embodiment of a protective device according to the present invention.
Figure 7:
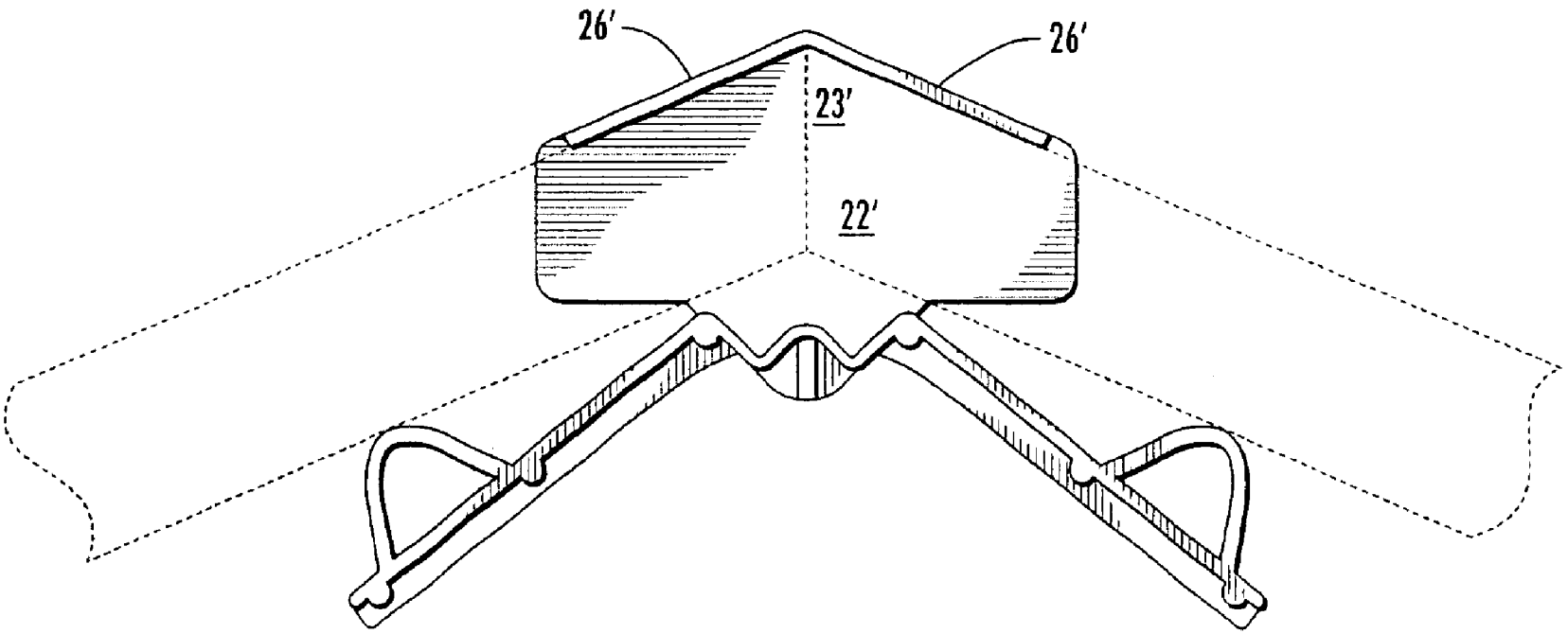
FIG. 7 is a top view of the protective device of FIG. 6 installed on a cabinet having a 135 degree corner.

It will be appreciate that a wide variety of different configurations for the ridge member and the reinforcing ribs may be used. For example, FIGS. 6 and 7 depict another embodiment of the present invention in which the reinforcing member 26' only extends along a portion of the outer portion 23' of cap member 22'. In this embodiment, no reinforcing ribs are provided. The reinforcing member may likewise be omitted altogether.

It will also be appreciated that the protective devices of the present invention may be used to protect the edges of objects as well as corners. For instance, the protective device 20 illustrated in FIGS. 1–5 may easily be used to protect a straight edge on a cabinet or other object as well as a corner. When used as an edge protector, the first and second arms 40, 41 are placed adjacent the inside face of the edge to be protected, and the first and second outer arms 30, 31 are placed adjacent the outside face of the edge to be protected. The protrusions 50, 51 on the first and second inner arms 40, 41 make contact with the inner face of the edge to be protected, and the distal ends 36, 37 of the first and second outer arms 30, 31 contact the outer face of the edge to be protected. The protective device 20 is held in place when used as an edge protector in the same manner that it is held in place when used as a corner protector; namely, placing the device over the edge acts to deflect the first and second inner arms 40, 41 from their relaxed positions so that the inner arms 40, 41 exert a force on the inner face of the edge to be protected that holds the protective device 20 in place. When used as an edge protector, preferably the distal ends 36, 37 of the first and second outer arms 30, 31 should extend near to, or even beyond, the vertical plane defined by the outermost points (i.e., the apexes) of protrusions 50, 51. Such a design helps to ensure that, in use, the first and second inner arms 40, 41 will be deflected sufficiently far enough from their relaxed positions so as to create a sufficient force to hold the protective device 20 in place. However, it may will appreciated that this goal may also be accomplished in other ways such as, for example, having the first and second inner arms 40, 41 extend from the rigid post so that they angle in the direction of the first and second outer arms 30, 31.

The present invention can be embodied in a variety of different forms. For example, the first and second outer arms 30, 31 may take on a variety of different shapes (e.g., rectangular, square, curved, etc.). The outer arms 30, 31 also need not meet to form an apex 34, although such a design is usually preferred as it may provide enhanced protection to the corner of the device. The cap member 22 may also be implemented in a variety of different shapes and sizes, and may or may not include reinforcing ribs or ridges or the like. The first and second inner arms 40, 41 may also be implemented in a variety of different shapes and sizes, and may include various different reinforcing structures such as ribs or thickened sections. The rigid post 44 may also be implemented in a variety of ways, and may be omitted altogether in certain embodiments.

Corner protectors of the invention may be formed of polymeric, typically thermoplastic, material, such as polystyrene, polyethylene, polypropylene, nylon, high impact polystyrene and ABS. The protector can be manufactured by injection molding in accordance with conventional techniques, so that the resulting part is a single integral unit of thermoplastic material.

It will also be appreciated that the present invention is described and claimed herein from an orientation where the device is used to protect a top corner or edge of an object. Accordingly, when the same protective device is used to protect a bottom edge or corner of an object the cap member will rest below the object and the inner and outer arms will extend upwardly from the cap member.

While the present invention has been described above with respect to the protective devices themselves and the cabinet or other object being protected shown in partial view only, it will be appreciated that the present invention also may be viewed as the combination of a cabinet or other object and a protective device as described above, with the protective device installed on the cabinet in the manner described above. A single protective device or multiple protective devices may be installed, along front and/or back, and along top and/or bottom corners, depending upon the features of the particular cabinet or other object being protected. Wood cabinets are particularly suitable for protection with the protective devices of the present invention, particularly where the corner joins two sides of different thickness as explained above.

The foregoing is illustrative of the present invention, and is not to be construed as limiting thereof. The invention is defined by the following claims, with equivalents of the claims to be included therein.

That which is claimed is:

1. A protective device useful for shielding one or more edge portions of an object from damage comprising:

a cap member;

a first outer arm connected to and extending downwardly from the cap member;

a second outer arm connected to and extending downwardly from the cap member;

a first resilient inner arm connected to and extending downwardly from the cap member and located opposite the first outer arm, the first inner arm including a first protrusion that projects toward the first outer arm;

a second resilient inner arm connected to and extending downwardly from the cap member and located opposite the second outer arm, the second inner arm including a second protrusion that projects toward the second outer arm;

wherein the first inner arm and the second inner arm are moveable about at least one axis that extends downwardly from a plane defined by the cap member; and wherein a plane defined by the first inner arm and a plane defined by the first outer arm intersect to define an acute angle when the first inner arm is in a relaxed state.

2. A protective device according to claim 1, wherein the first protrusion and the second protrusion are external to a footprint that is defined by an upper edge of the cap member.

3. A protective device according to claim 1, wherein the first protrusion and the second protrusion each have a hollow center.

4. A protective device according to claim 1, wherein the first outer arm and the second outer arm are positioned so as to define an obtuse angle opposite the plane defined by the downwardly extending first inner arm.

5. A protective device according to claim 4, wherein the obtuse angle is approximately 135 degrees.

6. A protective device according to claim 1, wherein the first inner arm and the second inner arm are connected to the cap member via a rigid post.

7. A protective device according to claim 6, wherein a rib is provided on the first inner arm adjacent the connection between the first inner arm and the rigid post.

8. A protective device according to claim 1, wherein the first protrusion comprises a U-shaped section of material that projects from a face of the first inner arm that is opposite the first outer arm and wherein the second protrusion comprises a U-shaped section of material that projects from a face of the second inner arm that is opposite the second outer arm.

9. A protective device according to claim 1, wherein a rib is provided adjacent each location where the first protrusion connects to the first inner arm.

10. A protective device according to claim 1, wherein the distal portion of the first outer arm is parallel to the first inner arm when the protective device is installed on the object.

11. The protective device according to claim 1, wherein a plane defined by the second inner arm and a plane defined by the second outer arm intersect to define an acute angle when the second inner arm is in a relaxed state.

12. The protective device according to claim 11, wherein the first inner arm and the second inner arm lie in a common plane when the first inner arm and the second inner arm are each in a relaxed state.

13. The protective device according to claim 1, wherein the first protrusion is configured to engage an inner face of one of the edge portions of the object.

14. A corner protector useful for shielding a corner of an object from damage comprising:

a cap member;

a first outer arm connected to and extending downwardly from the cap member;

a second outer arm connected to and extending downwardly from the cap member;

a resilient first inner arm connected to and extending downwardly from the cap member and located opposite the first outer arm; and a resilient second inner arm connected to and extending downwardly from the cap member and located opposite the second outer arm;

wherein the first outer arm and the second outer arm are positioned so as to define an obtuse angle opposite the vertical plane defined by the downwardly extending first inner arm.

15. A corner protector according to claim 14, wherein the first inner arm includes a first protrusion that projects toward the first outer arm and wherein the second inner arm includes a second protrusion that projects toward the second outer arm.

16. A corner protector according to claim 15, wherein the first protrusion and the second protrusion are external to a footprint that is defined by an upper edge of the cap member.

17. A corner protector according to claim 15, wherein the first protrusion and the second protrusion each have a hollow center.

18. A corner protector according to claim 15, wherein the first protrusion comprises a U-shaped section of material that projects from a face of the first inner arm that is opposite the first outer arm and wherein the second protrusion comprises a U-shaped section of material that projects from a face of the second inner arm that is opposite the second outer arm.

19. A corner protector according to claim 14, wherein the first inner arm has a distal end and the second inner arm has a distal end, and wherein the protective device is configured so that in use the distal end of the first inner arm is not in contact with the object and the distal end of the second inner arm is not in contact with the object.

20. A corner protector according to claim 14, wherein the obtuse angle is approximately 135 degrees.

21. A protective device useful for shielding one or more edge portions of an object from damage comprising:

a cap member;

a first outer arm connected to and extending downwardly from the cap member;

a second outer arm connected to and extending downwardly from the cap member;

a resilient first inner arm connected to and extending downwardly from the cap member and located opposite the first outer arm; and a resilient second inner arm connected to and extending downwardly from the cap member and located opposite the second outer arm, the second inner arm in its relaxed state being substantially coplanar with the first inner arm;

wherein the first outer arm and the second outer arm are positioned so as to define an obtuse angle opposite the plane defined by the downwardly extending first inner arm.

22. A protective device according to claim 21, wherein the obtuse angle is approximately 135 degrees.

23. A protective device useful for shielding one or more edge portions of an object from damage comprising:

a cap member;

a first outer arm connected to and extending downwardly from the cap member;

a second outer arm connected to and extending downwardly from the cap member;

a resilient first inner arm connected to and extending downwardly from the cap member and located opposite the first outer arm; and a resilient second inner arm connected to and extending downwardly from the cap member and located opposite the second outer arm, the second inner arm in its relaxed state being substantially coplanar with the first inner arm;

wherein the first inner arm includes a first protrusion that projects toward the first outer arm and the second inner arm includes a second protrusion that projects toward the second outer arm.

24. A protective device according to claim 23, wherein the first protrusion and the second protrusion are external to an outer perimeter that is defined by an upper edge of the cap member.

25. A protective device according to claim 23, wherein the first protrusion and the second protrusion each have a hollow center.

* * * * *